US009403662B1

(12) United States Patent
Evans et al.

(10) Patent No.: US 9,403,662 B1
(45) Date of Patent: Aug. 2, 2016

(54) RETRACTABLE OXYGEN TUBE ASSEMBLY

(71) Applicants: Neil A. Evans, Wheelersburg, OH (US); Gary McIlvain, Wheelersburg, OH (US); Charles McIlvain, Wheelersburg, OH (US)

(72) Inventors: Neil A. Evans, Wheelersburg, OH (US); Gary McIlvain, Wheelersburg, OH (US); Charles McIlvain, Wheelersburg, OH (US)

( * ) Notice: Subject to any disclaimer, the term of this patent is extended or adjusted under 35 U.S.C. 154(b) by 0 days.

(21) Appl. No.: 14/639,227

(22) Filed: Mar. 5, 2015

(51) Int. Cl.
*B65H 75/44* (2006.01)

(52) U.S. Cl.
CPC ..... *B65H 75/4486* (2013.01); *B65H 75/4478* (2013.01); *B65H 75/4484* (2013.01); *B65H 2701/33* (2013.01); *Y10T 137/694* (2015.04); *Y10T 137/6932* (2015.04); *Y10T 137/6936* (2015.04); *Y10T 137/6943* (2015.04)

(58) Field of Classification Search
CPC ..... B65H 75/4486; B65H 75/4478; B65H 75/4484; B65H 2701/33; Y10T 137/6932; Y10T 137/6936; Y10T 137/694; Y10T 137/6943
USPC ..... 137/355.16, 355.2–355.28
See application file for complete search history.

(56) References Cited

U.S. PATENT DOCUMENTS 1,776,227 A * 9/1930 Wieland ..... B21D 51/46 413/9
3,137,452 A * 6/1964 Winders ..... B21C 47/18 242/128
3,994,519 A * 11/1976 Williams ..... B65D 55/06 292/246
4,117,991 A * 10/1978 Johnson ..... B65H 54/56 242/398
5,236,143 A * 8/1993 Dragon ..... B65H 75/48 226/187
5,392,808 A * 2/1995 Pierce ..... B65H 75/38 128/202.27
5,495,995 A * 3/1996 Dominique ..... B65H 75/38 242/390.1
5,568,824 A * 10/1996 Cordrey ..... B65H 75/38 137/334
5,647,554 A * 7/1997 Ikegami ..... B25J 19/0025 191/12.2 A
5,826,606 A 10/1998 Davenport
5,975,120 A 11/1999 Novosel
6,065,490 A 5/2000 Falcone, Jr.
6,588,444 B2 7/2003 Paplow et al.
6,591,858 B2 7/2003 Peterson
7,104,491 B2 9/2006 Vinding
D595,121 S 6/2009 Murphy
2012/0048983 A1* 3/2012 Bianco ..... B60L 11/1818 242/388.9

FOREIGN PATENT DOCUMENTS

FR 1341540 A * 11/1963 ..... A01D 34/001

OTHER PUBLICATIONS

NPL #1—English machine translation of FR 1341540 A as provided by EPO.*

* cited by examiner

*Primary Examiner* — Kevin Murphy
*Assistant Examiner* — Josephine Trinidad-Borges

(57) ABSTRACT

A retractable oxygen tube assembly provides an oxygen tube that can be safely retracted into and out of a housing. The assembly includes a housing and an aperture extending through the housing. A reel is positioned in an interior space of the housing. A hose has a first end coupled to the reel and a second end selectively extendable from the reel through the aperture in the housing. An oxygen port coupled to the housing is in fluid communication with the hose dispensing oxygen through hose. A motor is coupled to the housing and selectively engages the reel wherein the reel is rotated by the motor retracting the hose onto the reel when the motor is actuated.

13 Claims, 5 Drawing Sheets

10
12
14
16
20
24
28
30
30
32
36
40
42
42
42
42
44
44
44
44
46
76
78
82
84

RETRACTABLE OXYGEN TUBE ASSEMBLY

BACKGROUND OF THE DISCLOSURE

Field of the Disclosure

The disclosure relates to oxygen tube assemblies and more particularly pertains to a new oxygen tube assembly for providing an oxygen tube that can be safely retracted into and out of a housing.

SUMMARY OF THE DISCLOSURE

An embodiment of the disclosure meets the needs presented above by generally comprising a housing and an aperture extending through the housing. A reel is positioned in an interior space of the housing. A hose has a first end coupled to the reel and a second end selectively extendable from the reel through the aperture in the housing. An oxygen port coupled to the housing is in fluid communication with the hose dispensing oxygen through hose. A motor is coupled to the housing and selectively engages the reel wherein the reel is rotated by the motor retracting the hose onto the reel when the motor is actuated.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
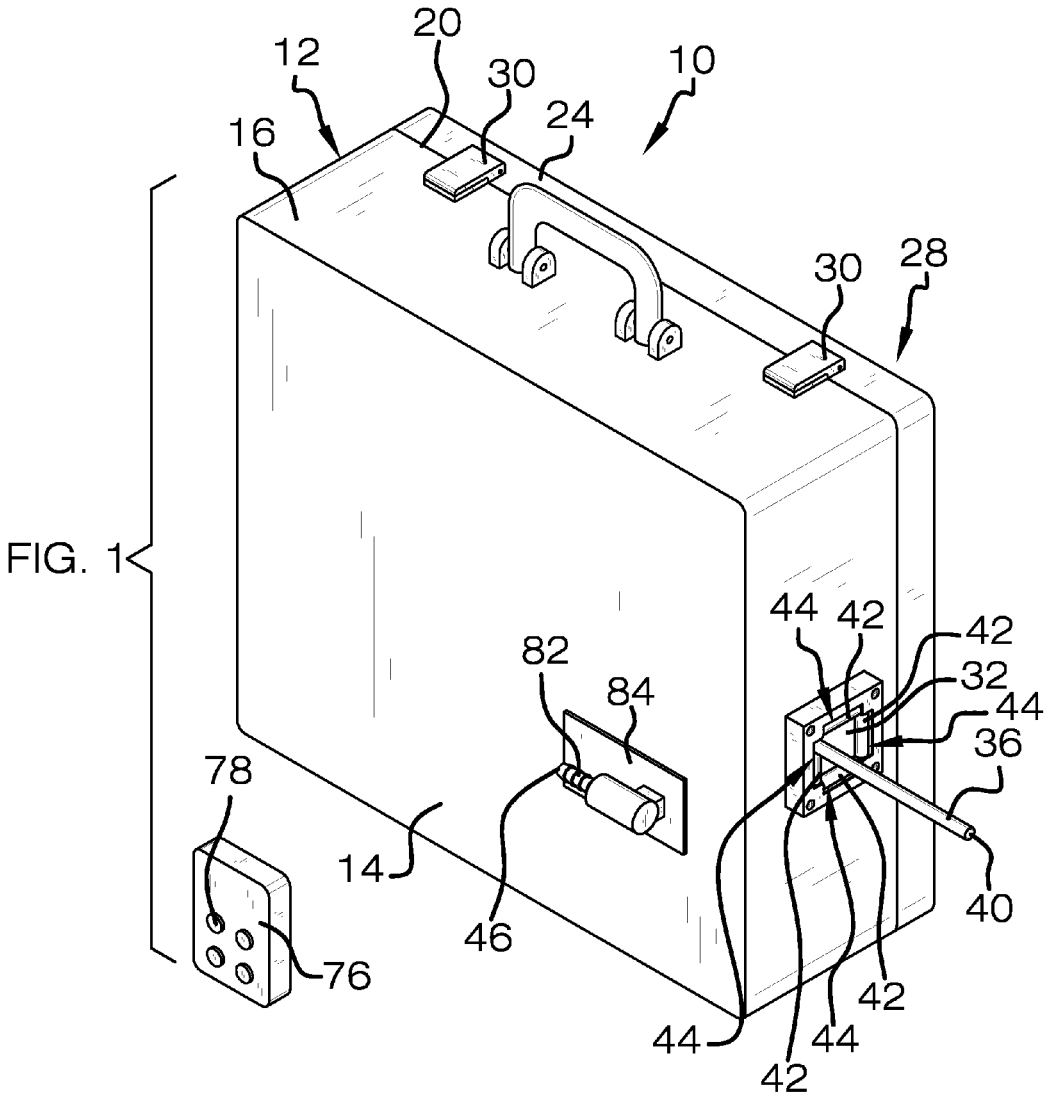
FIG. 1 is a bottom side perspective view of a retractable oxygen tube assembly according to an embodiment of the disclosure.
Figure 2:
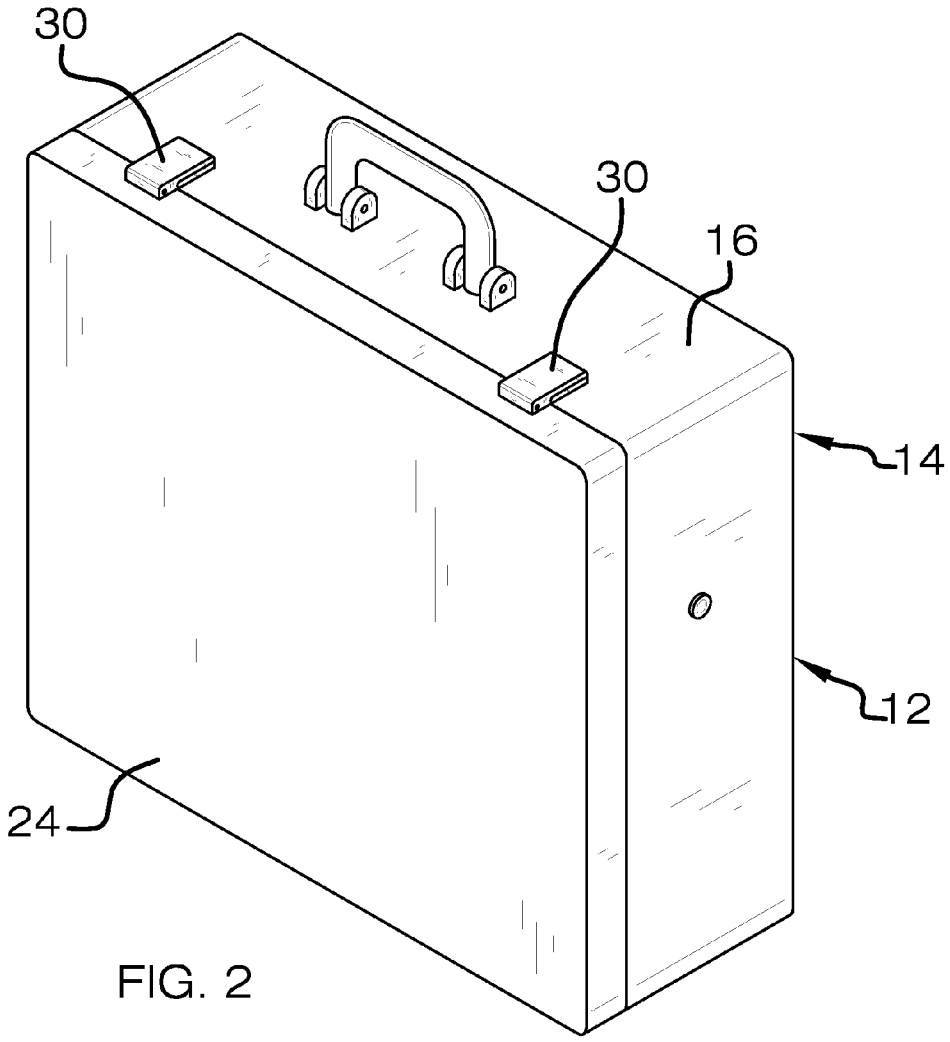
FIG. 2 is a top side perspective view of an embodiment of the disclosure.
Figure 3:
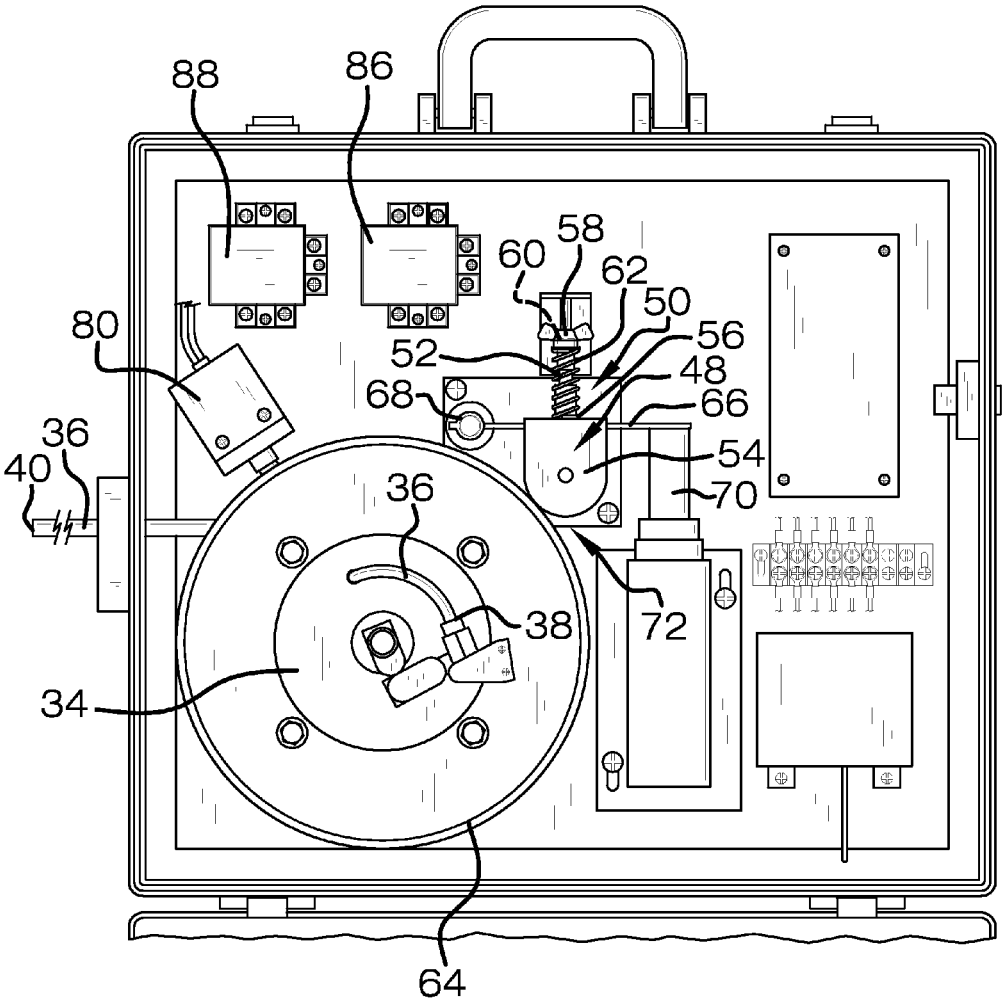
FIG. 3 is a top view of an embodiment of the disclosure in an open position and motor engaged position.
Figure 4:
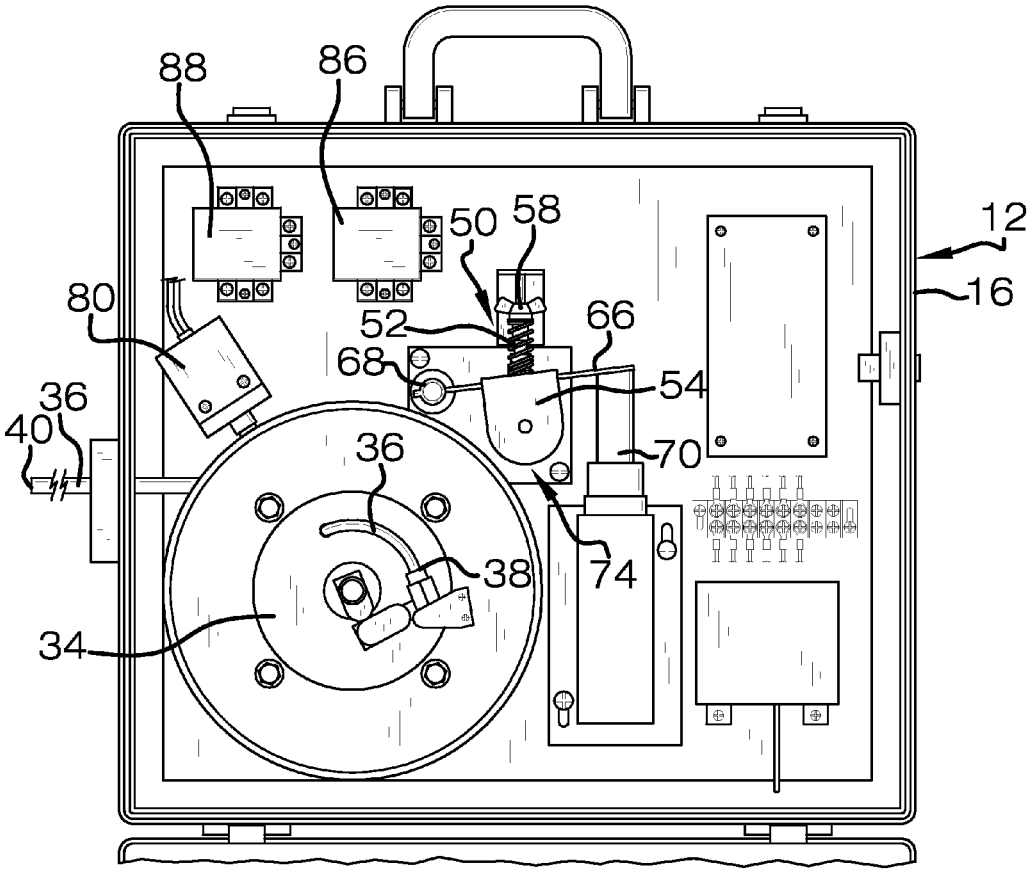
FIG. 4 is a top view of an embodiment of the disclosure in an open and motor disengaged position.
Figure 5:
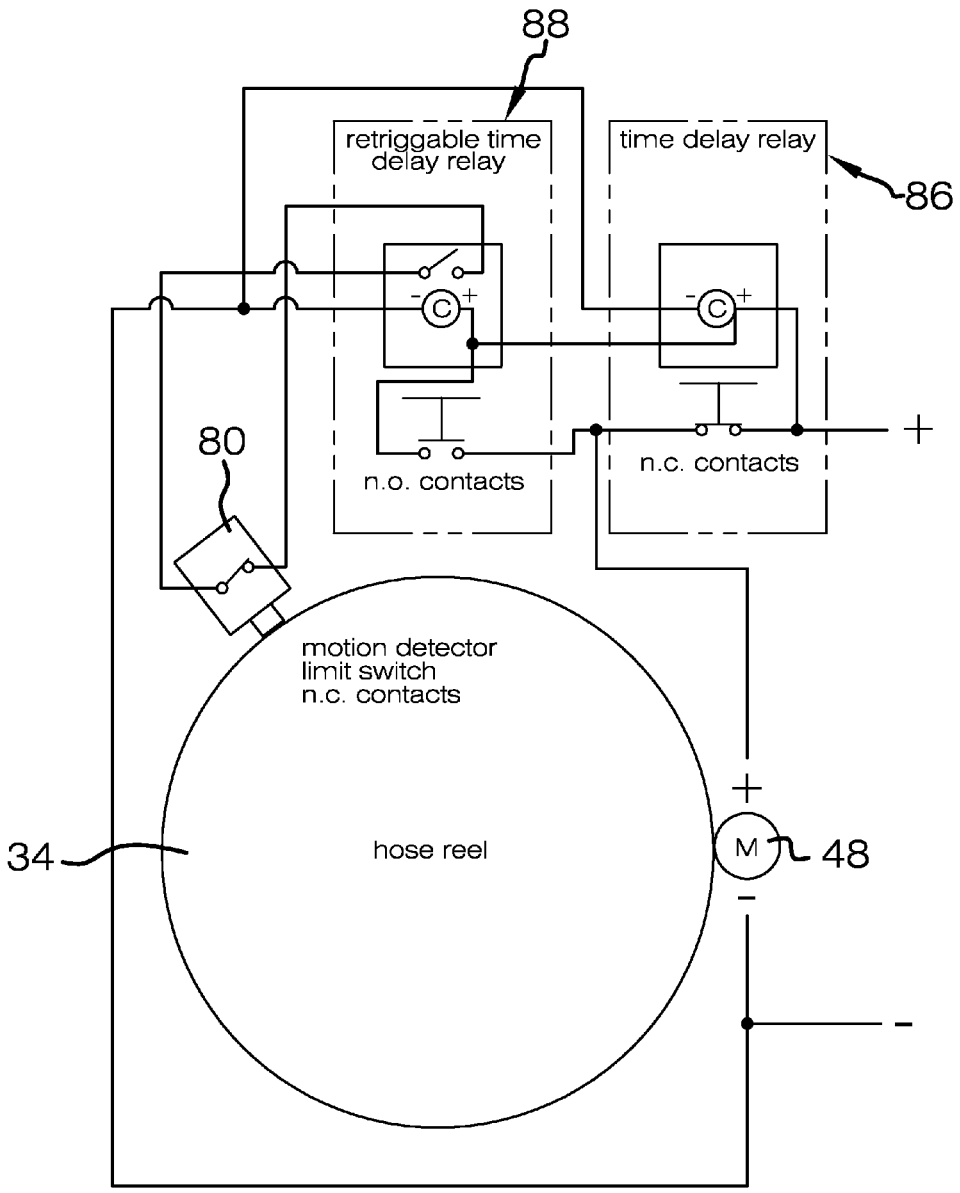
FIG. 5 is an electrical circuit diagram of an embodiment of the disclosure.

With reference now to the drawings, and in particular to FIGS. 1 through 5 thereof, a new oxygen tube assembly embodying the principles and concepts of an embodiment of the disclosure and generally designated by the reference numeral 10 will be described.

As best illustrated in FIGS. 1 through 5, the retractable oxygen tube assembly 10 generally comprises a housing 12 having a bottom wall 14 and a perimeter wall 16 coupled to and extending from the bottom wall 14 defining in interior space 18 of the housing 12. A top edge 20 of the perimeter wall 16 defines an opening 22 into the interior space 18 of the housing 12. A lid 24 is pivotally coupled to the housing 12. The lid 24 is pivotable between an open position 26 wherein the lid 24 permits access to the interior space 18 through the opening 20 and a closed position 28 wherein the lid 24 covers the opening 20 into the interior space 18. At least one latch 30 is coupled to the housing 12. The latch 30 selectively engages the lid 24 such that the lid 24 is held in the closed position 28 by the latch 30.

An aperture 32 extends through the housing 12 and may more particularly extend through the perimeter wall 16 of the housing 12. A reel 34 is coupled to the housing 12 and positioned in the interior space 18 of the housing 12 proximate the aperture 32. A hose 36 has a first end 38 coupled to the reel 34. The hose 36 is extended around the reel 34 wherein a second end 40 of the hose 36 is selectively extendable from the reel 34 through the aperture 32 in the housing 12. Each of a plurality of rollers 42 may be coupled to the housing 12. Each roller 42 may be elongated and substantially cylindrical. The rollers 42 are arranged coextensive with edges 44 of the aperture 32 wherein the rollers 42 reduce friction between the edges 44 of the aperture 32 and the hose 36 when the hose 36 contacts the edges 44 of the aperture 32.

An oxygen port 46 is coupled to the housing 12. The oxygen port 46 is configured for coupling to an oxygen source, such as an oxygen tank, by way of tubing or the like. Thus, oxygen is delivered through the oxygen port 46. The oxygen port 46 is in fluid communication with the hose 36 wherein the hose 36 is configured for receiving oxygen into the hose 36 and dispensing oxygen through the second end 40 of the hose 36. The second end 40 of the hose 36 may be coupled to a conventional mask or outlet positionable adjacent to or in one of more nostrils of a person requiring or desiring supplemental oxygen. The oxygen port 46 may extend through the bottom wall 14 of the housing 12. The oxygen port 46 may include a circumferentially notched distal extent 82 designed to engage the tubing from the oxygen source. A panel 84 having a rectangular shape may be incorporated into the oxygen port 46 coplanar with the bottom wall 14 to prevent rotation of the oxygen port 46 relative to the bottom wall 14. Fluid communication between the oxygen port 46 and the first end 38 of the hose 36 coupled to the reel 34 may be provided in a conventional manner such that rotation of the reel 34 is not restricted.

A motor 48 is coupled to the housing 12. The motor 48 is selectively engageable to the reel 34 wherein the reel 34 is rotated by the motor 48 to retract the hose 36 onto the reel 34 when the motor 48 is actuated. Thus, the assembly 10 allows for use of a hose 36 have a long length permitting the person to move freely without having to also carry or transport the oxygen source. Retraction of the hose 36 onto the reel 34 prevents the hose 36 from tripping the person, snagging on objects, or the like, while the person remains in closer proximity to the housing 12 and oxygen source.

A tension mechanism 50 is coupled to the housing 12. The motor 48 is coupled to the tension mechanism 50. The tension mechanism 50 adjustably urges the motor 48 into abutment with the reel 34 wherein frictional engagement between the motor 48 and the reel 34 is adjusted by the tension mechanism 50. The tension mechanism 50 may comprise a post 52. The motor 48 is slidably coupled to the post 52 by way of a harness or seat 54 positioned proximate a first end 56 of the post 52. A wing nut 58 or similar screw type block is coupled to the post 52 by threading 60. The wing nut 58 is selectively positionable along a length of the post 52 a selectable distance from the first end 56 of the post 52. A biasing member 62 is coupled to the post 52 extending between the wing nut 58 and the motor 48 such that adjustment of the wing nut 58 along the post 52 compresses or expands the biasing member 62 to vary resistance to sliding of the motor 48 relative to the post 52. A frictional layer 64 or band may be coupled to a perimeter of the reel 34 to be contacted by the motor 48 facilitating frictional engagement of the motor 48 to the reel 34. The tension mechanism 50 may be set to allow slippage between the motor 48 and the reel 34 such that the motor 48 is prevented from rotating the reel 34 when the hose 36 exerts resistance to being retracted beyond a desired threshold. The threshold may be set sufficiently low that the motor 48 will not forcefully detach the second end 40 of the hose 36 from a user, pull the user over, pull the housing 12 over, or the like. A tension arm 66 has a first end 68 pivotally coupled to the housing 12. The tension mechanism 50 may be coupled to the tension arm 66. A piston 70 is coupled to the housing 12 and the tension arm 66. The piston 70 selectively pivots the tension arm 66 between a first position 72 and a second position 74. The motor 48 engages the reel 34 in the first position 72 and the motor 48 is disengaged from the reel 34 in the second position 74 wherein the motor 48 is selectively engaged to and disengaged from the reel 34 by the piston 70.

A remote control 76 may be provided and carried by a person using the assembly 10 to provide oxygen. The remote control 76 is communicatively coupled to the motor 48 wherein the motor 48 is selectively activated by operation of the remote control 76. The remote control 76 may include an activation button 78 which causes the piston 70 to engage the motor 48 to the reel 34 while the motor 48 is activated.

Protection from excessive wear on the motor 48 or the abutting surface of the motor 48 and the reel 34 may be provided. A motion detector 80 may be coupled to and positioned in the housing 12 monitoring rotation of the reel 34. The motion detector 80 is communicatively coupled to the motor 48 and the piston 70 wherein the piston 70 disengages the motor 48 from the reel 34 upon the motion detector 80 detecting a lack of rotation of the reel 34 while the motor 48 is activated. A first time delay mechanism 86 is operationally coupled to the motor 48 such that the motor 48 is prevented from being deactivated during an initial period of time when the motor 48 is first actuated. The initial period of time may be determined by a duration of time equivalent to permit one full rotation of the reel 34 while the motor 48 is actuated. A second time delay mechanism 88 is operationally coupled to the motor 48 in combination with the first time delay mechanism 86. Each may be a form of relay in circuit with the motor 48 and piston 70 such that closing of the circuit through either of the first time delay mechanism 86 or the second time delay mechanism 88 is required to deactivate the motor 48. The motion detector 80 may be operationally coupled to the second time delay mechanism 88 such that the motor 48 is prevented from being deactivated for a pre-determined time increment when the motion detector 80 detects continuing movement of the reel 34. The pre-determined time increment may be a duration of time equivalent to one half rotation of the reel 34 while the motor 48 is actuated. The second time delay mechanism 88 is automatically reset upon expiration of each pre-determined time increment when the motion detector 80 detects continued motion at the expiration of an immediately prior time increment. Thus, the motor 48 will continue to retract the hose 36 onto the reel 34 so long as the motion detector 80 detects continued motion of the reel 34.

In use, the assembly 10 allows for free extension of the hose 36 from the housing 12 through the aperture 32 permitting a user to move an extended distance from the housing 12. When returning to a position near the housing 12, the remote control 76 may be manipulated to engage the motor 48 to the reel 34, retracting the hose 36 into the housing 12. Frictional engagement of the motor 48 to the reel 34 is adjustable to permit slippage of the motor 48 relative to the reel 34 when excess tension is present in the hose 36. Automatic deactivation of the motor 48 is provided for as described above when the reel stops moving due to excess tension in the hose 36, which may be from snagging or full retraction of the hose 36.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A retractable oxygen tube assembly comprising:

a housing having a bottom wall and a perimeter wall coupled to and extending from said bottom wall defining an interior space of said housing;

an aperture extending through said housing;

a reel coupled to said housing, said reel being positioned in said interior space of said housing;

a hose having a first end coupled to said reel, said hose being extended around said reel wherein a second end of said hose is selectively extendable from said reel through said aperture in said housing;

an oxygen port coupled to said housing, said oxygen port being configured for coupling to an oxygen source wherein oxygen is delivered through said oxygen port, said oxygen port being in fluid communication with said hose wherein said hose is configured for receiving oxygen into said hose and dispensing oxygen through said second end of said hose;

a motor coupled to said housing, said motor being selectively engageable to said reel wherein said reel is rotated by said motor retracting said hose onto said reel when said motor is actuated;

a tension mechanism coupled to said housing, said motor being coupled to said tension mechanism, said tension mechanism adjustably urging said motor into abutment with said reel wherein frictional engagement between said motor and said reel is adjusted by said tension mechanism; and said tension mechanism comprising: a post, said motor being slidably coupled to said post proximate a first end of said post; a wing nut selectively positionable along a length of said post; and a biasing member coupled to said post extending between said wing nut and said motor such that adjustment of said wing nut along said post varies resistance to sliding of said motor relative to said post.

2. The assembly of claim 1, further comprising:

a tension arm having a first end pivotally coupled to said housing, said tension mechanism being coupled to said tension arm; and a piston coupled to said housing and said tension arm, said piston selectively pivoting said tension arm between a first position and a second position, said motor engaging said reel in said first position and said motor being disengaged from said reel in said second position wherein said motor is selectively engaged to and disengaged from said reel by said piston.

3. The assembly of claim 2, further comprising a motion detector coupled to and positioned in said housing, said motion detector monitoring rotation of said reel, said motion detector being communicatively coupled to said motor wherein said piston disengages said motor from said reel upon said motion detector detecting a lack of rotation of said reel while said motor is activated.

4. The assembly of claim 1, further comprising a remote control, said remote control being communicatively coupled to said motor wherein said motor is selectively activated by operation of said remote control.

5. The assembly of claim 1, further comprising a plurality of rollers coupled to said housing, said rollers being arranged coextensive with edges of said aperture wherein said rollers reduce friction between said edges of said aperture and said hose when said hose contacts said edges of said aperture.

6. The assembly of claim 1, further comprising:

a top edge of said perimeter wall defining an opening into said interior space of said housing; and a lid pivotally coupled to said housing, said lid being pivotable between an open position wherein said lid permits access to said interior space through said opening into said interior space and a closed position wherein said lid covers said opening into said interior space.

7. The assembly of claim 6, further comprising a latch coupled to said housing, said latch selectively engaging said lid such that said lid is held in said closed position by said latch.

8. The assembly of claim 3, further comprising a first time delay mechanism being operationally coupled to said motor such that said motor is prevented from being deactivated during an initial period of time when said motor is first actuated.

9. The assembly of claim 8, further comprising said initial period of time being determined by a duration of time equivalent to one full rotation of said reel while said motor is actuated.

10. The assembly of claim 8, further comprising a second time delay mechanism being operationally coupled to said motor and said motion detector such that said motor is prevented from being deactivated for a pre-determined time increment when said motion detector detects continuing movement of said reel.

11. The assembly of claim 10, further comprising said pre-determined time increment being a duration of time equivalent to one half rotation of said reel while said motor is actuated.

12. The assembly of claim 10, further comprising said second time delay being automatically reset upon expiration of each said pre-determined time increment when said motion detector detects continued motion at the expiration of an immediately prior said time increment.

13. A retractable oxygen tube assembly comprising:

a housing having a bottom wall and a perimeter wall coupled to and extending from said bottom wall defining an interior space of said housing;

a top edge of said perimeter wall defining an opening into said interior space of said housing;

a lid pivotally coupled to said housing, said lid being pivotable between an open position wherein said lid permits access to said interior space through said opening into said interior space and a closed position wherein said lid covers said opening into said interior space;

a latch coupled to said housing, said latch selectively engaging said lid such that said lid is held in said closed position by said latch;

an aperture extending through said housing;

a reel coupled to said housing, said reel being positioned in said interior space of said housing;

a hose having a first end coupled to said reel, said hose being extended around said reel wherein a second end of said hose is selectively extendable from said reel through said aperture in said housing;

a plurality of rollers coupled to said housing, said rollers being arranged coextensive with edges of said aperture wherein said rollers reduce friction between said edges of said aperture and said hose when said hose contacts said edges of said aperture;

an oxygen port coupled to said housing, said oxygen port being configured for coupling to an oxygen source wherein oxygen is delivered through said oxygen port, said oxygen port being in fluid communication with said hose wherein said hose is configured for receiving oxygen into said hose and dispensing oxygen through said second end of said hose;

a motor coupled to said housing, said motor being selectively engageable to said reel wherein said reel is rotated by said motor retracting said hose onto said reel when said motor is actuated;

a tension mechanism coupled to said housing, said motor being coupled to said tension mechanism, said tension mechanism adjustably urging said motor into abutment with said reel wherein frictional engagement between said motor and said reel is adjusted by said tension mechanism, said tension mechanism comprising a post, said motor being slidably coupled to said post proximate a first end of said post, a wing nut selectively positionable along a length of said post, and a biasing member coupled to said post extending between said wing nut and said motor such that adjustment of said wing nut along said post varies resistance to sliding of said motor relative to said post;

a tension arm having a first end pivotally coupled to said housing, said tension mechanism being coupled to said tension arm;

a piston coupled to said housing and said tension arm, said piston selectively pivoting said tension arm between a first position and a second position, said motor engaging said reel in said first position and said motor being disengaged from said reel in said second position wherein said motor is selectively engaged to and disengaged from said reel by said piston;

a remote control, said remote control being communicatively coupled to said motor wherein said motor is selectively activated by operation of said remote control;

a motion detector coupled to and positioned in said housing, said motion detector monitoring rotation of said reel, said motion detector being communicatively coupled to said motor wherein said piston disengages said motor from said reel upon said motion detector detecting a lack of rotation of said reel while said motor is activated;

a first time delay mechanism being operationally coupled to said motor such that said motor is prevented from being deactivated during an initial period of time when said motor is first actuated, said initial period of time being determined by a duration of time equivalent to one full rotation of said reel while said motor is actuated; and a second time delay mechanism being operationally coupled to said motor and said motion detector such that said motor is prevented from being deactivated for a pre-determined time increment when said motion detector detects continuing movement of said reel, said pre-determined time increment being a duration of time equivalent to one half rotation of said reel while said motor is actuated, said second time delay being automatically reset upon expiration of each said pre-determined time increment when said motion detector detects continued motion at the expiration of an immediately prior said time increment.

* * * * *